US010744622B2

(12) United States Patent
Herrmann

(10) Patent No.: US 10,744,622 B2
(45) Date of Patent: Aug. 18, 2020

(54) PLIERS

(71) Applicant: KNIPEX-Werk C. Gustav Putsch KG, Wuppertal (DE)

(72) Inventor: Bernd Herrmann, Wuppertal (DE)

(73) Assignee: KNIPEX-Werk C. Gustav Putsch KG, Wuppertal (DE)

( * ) Notice: Subject to any disclaimer, the term of this patent is extended or adjusted under 35 U.S.C. 154(b) by 175 days.

(21) Appl. No.: 15/123,347

(22) PCT Filed: Mar. 3, 2015

(86) PCT No.: PCT/EP2015/054395
§ 371 (c)(1),
(2) Date: Sep. 2, 2016

(87) PCT Pub. No.: WO2015/132247
PCT Pub. Date: Sep. 11, 2015

(65) Prior Publication Data

US 2017/0066112 A1 Mar. 9, 2017

(30) Foreign Application Priority Data

Mar. 5, 2014 (DE) ..... 10 2014 102 927

(51) Int. Cl.
*B25B 7/10* (2006.01)

(52) U.S. Cl.
CPC ..... *B25B 7/10* (2013.01)

(58) Field of Classification Search
CPC .... B25B 7/10; B25B 7/14; B25B 7/04; B25B 7/12

(Continued)

(56) References Cited

U.S. PATENT DOCUMENTS 4,048,878 A * 9/1977 Nystrom ..... B25B 7/10 81/409
4,438,669 A * 3/1984 Hastings ..... B25B 7/10 81/409.5

(Continued)

FOREIGN PATENT DOCUMENTS

DE 91 13 870 U1 12/1992
FR 2 456 592 A1 12/1980

(Continued)

OTHER PUBLICATIONS

International Search Report of PCT/EP2015/054395, dated Jun. 19, 2015.

(Continued)

*Primary Examiner* — Brian D Keller
(74) *Attorney, Agent, or Firm* — Collard & Roe, P.C.

(57) ABSTRACT

Pliers having two pliers legs that cross at a pivot bolt, of which pliers leg is fixed and the other is movable with respect thereto, wherein the pivot bolt is optionally fixable in a longitudinal slot in the fixed pliers leg by toothing engagement in order to set a mouth opening width, by means of engagement teeth formed on the longitudinal slot and one or more mating teeth formed on the pivot bolt. The toothing engagement is releasable by the pivot bolt being pressed down in a first direction of movement and subsequently the pliers legs being moved together, or by the pivot bolt automatically passing over one or more engagement teeth, wherein the pivot bolt moves in a second direction of movement on passing over an engagement tooth. A movement block is provided at least partially on one pliers leg and are effective for some of the engagement teeth, and the movement block comes into effect during a displacement of the pliers legs together, being effective for the second direction of movement of the pivot bolt.

4 Claims, 10 Drawing Sheets

Figure 1:
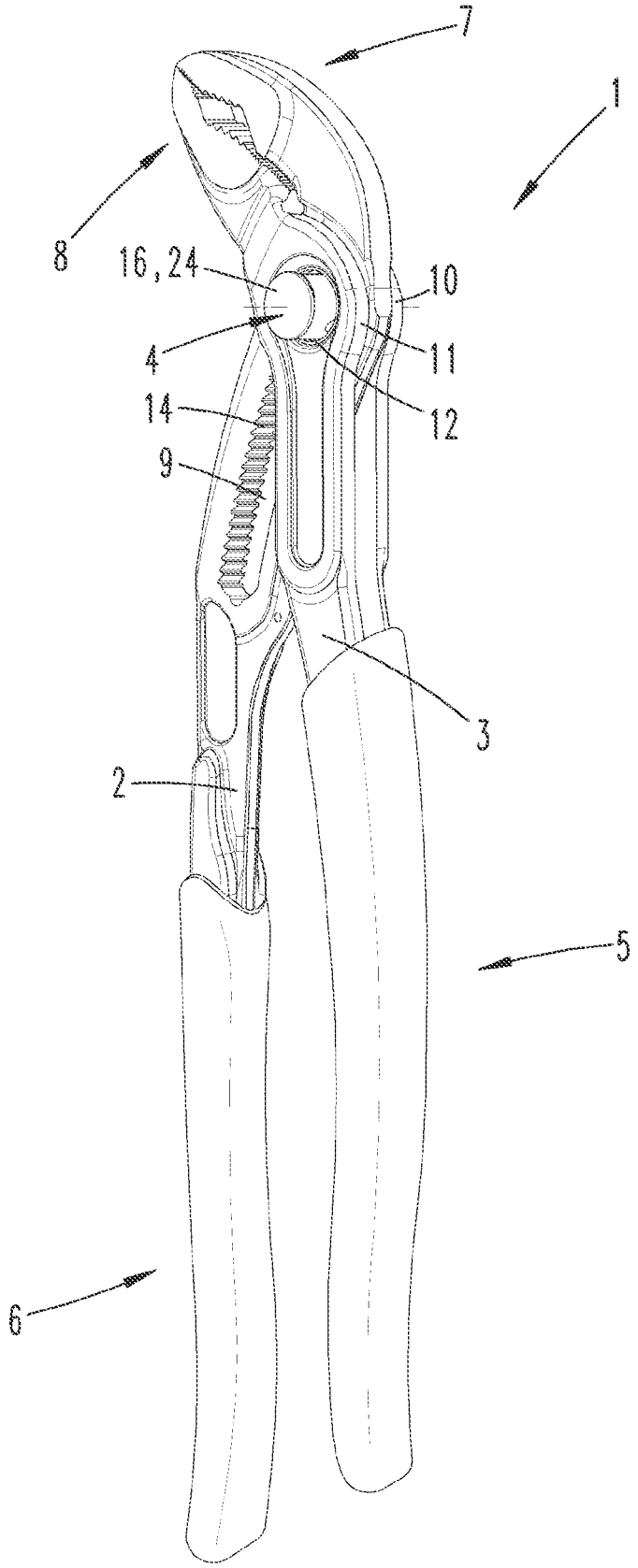

(58) Field of Classification Search
USPC .... 81/409, 409.5, 411, 413, 427.5, 385, 396
See application file for complete search history.

(56) References Cited

U.S. PATENT DOCUMENTS 4,581,960 A * 4/1986 Putsch ..... B25B 7/10 81/394
4,584,960 A * 4/1986 Colling, Jr. ..... B64D 13/04 114/333
4,651,598 A * 3/1987 Warheit ..... B25B 7/10 81/314
5,020,399 A * 6/1991 Annis ..... B25B 7/00 81/358
5,461,951 A 10/1995 Putsch
5,676,029 A 10/1997 Putsch
6,467,380 B1 * 10/2002 Azkona ..... B25B 7/12 81/357
6,892,609 B2 * 5/2005 Kuo ..... B25B 7/10 81/409.5
7,182,004 B1 * 2/2007 Wang ..... B25B 7/10 81/409.5
D589,315 S * 3/2009 Herrmann ..... D8/52
7,503,243 B2 * 3/2009 Putsch ..... B25B 7/10 81/409.5
7,614,324 B2 * 11/2009 Bocquet ..... B25B 7/10 81/355
8,661,948 B2 * 3/2014 DeBaker ..... B21K 5/00 81/405
8,695,464 B2 * 4/2014 Herrmann ..... B25B 7/10 81/409
2010/0064861 A1 3/2010 Herrmann
2012/0111156 A1 * 5/2012 DeBaker ..... B25B 7/22 81/405

FOREIGN PATENT DOCUMENTS

WO 00/76728 A1 12/2000
WO 2008/049850 A1 5/2008

OTHER PUBLICATIONS

Letter dated Nov. 5, 2015 from the German patent attorney to the European Patent Office regarding PCT/EP2015/054395 with English translation of relevant parts.
Letter dated Apr. 21, 2016 from the German patent attorney to the European Patent Office regarding PCT/EP2015/054395 with English translation of relevant parts.

* cited by examiner 7
9
23
14
22
21
10
11
1
16
24
b
a
12
8
25
27
26
15
13
17
2
20
3

PLIERS

CROSS REFERENCE TO RELATED APPLICATIONS

This application is the National Stage of PCT/EP2015/054395 filed on Mar. 3, 2015, which claims priority under 35 U.S.C. § of German Application No. 10 2014 102 927.5 filed on Mar. 5, 2014, the disclosures of which are incorporated by reference. The international application under PCT article 21(2) was not published in English.

The invention related to a pliers according to the features of the introductory clause of claim 1.

a Such a pliers having two pliers legs that cross at a pivot bolt, of which one pliers leg can be regarded as fixed and the other as movable with respect hereto, wherein the pliers legs form grip portions on oneside of the pivot bolt and mouth jaws cooperating as pliers mouth on the other side of the pivot bolt, wherein furthermore the pivot bolt is optionally fixable in a longitudinal slot formed in the fixed pliers leg by toothing engagement in order to set a mouth opening width, by means of engagement teeth formed over an extent of the longitudinal slot formed thereon and one or more mating teeth formed on the pivot bolt, and wherein furthermore a release of the toothing engagement for adjusting the mouth width is able to be carried out by pressing down the pivot bolt in a first direction of movement and subsequent displacement of the pliers legs together with the pivot bolt pressed down, or in that the pivot bolt automatically passes over one or more engagement teeth, wherein the pivot bolt, on passing over of an engagement tooth, moves in a second direction of movement, wherein means are furthermore provided for a movement block, which serve to prevent the pivot bolt from moving in the second direction of movement, but which continue to permit an adjustment as a result of pressing down of the pivot bolt.

Such a pliers is known from WO 2008/049850 (US 2010/0064861 A1). The automatic passing over takes place during a conventional displacement of the pliers legs for instance in the direction of a smaller mouth opening width, without another action on the pivot bolt being necessary. The passing over of the engagement teeth takes place in practical terms in the manner of a ratchet. As regards means for a movement block, it is known here to provide furthermore a head part of the pivot bolt so as to be rotatable with respect to the pivot bolt. For this, the head part has on the underside a pin, which can be moved, to achieve the movement block, into a free space between the pivot bolt and an associated flank of the longitudinal slot, on the side lying opposite the toothing. Alternatively, a rotary part can also be formed, provided parallel to a flat side of the pivot bolt, which rotary part is movable in the same way in a blocking manner into the said free space.

These known configurations are comparatively complex. The invention is concerned with the problem of specifying a pliers which has means for achieving the movement block that are as simple as possible but also advantageous for practical handling.

This problem is solved in a pliers having the features of claim 1, wherein it is aimed that the means for the movement block in particular having the features already indicated above, in which it is aimed that the movement block is provided at least partially on one pliers leg and is effective for some of the engagement teeth, and that the movement block comes into effect during a displacement of the pliers legs together in the second direction of movement.

The means for achieving the movement block are provided at least partially, preferably primarily, on one of the pliers legs itself and not, or only partially, on the pivot bolt. The means do not have to be brought separately into an operative position. The means also come into effect by themselves each time in the case of a corresponding actuation of the pliers.

Through the fact that the movement block comes into effect as a result of a displacement of the pliers legs together for changing the mouth opening width, the movement block can be achieved during a conventional handling of the pliers. It is preferably not necessary to undertake a special manipulation on a pliers leg or on the pivot bolt.

In particular, the actuation of a special adjustment part is preferably not necessary.

Though the fact that the actuation block is able to be achieved by differently deep introduction of the pivot bolt into the longitudinal slot in the opposite direction to a pressing down of the pivot bolt, a (different) movement not relevant for the user/an introducing of the pivot bolt contrary to the first direction of movement into the longitudinal slot is associated. A first introduction position, in which the movement block is in effect and a second introduction position, in which it is not.

In a further detail, it is preferred that a longitudinal flank of the longitudinal slot is provided over a portion of its length with a recess which enables a deeper introduction of the pivot bolt. Thus primarily only one particular configuration of a marginal edge of the longitudinal slot is necessary, in order to achieve the desired movement block. Through the fact that the recess is provided only over a portion of the length of the longitudinal flank of the longitudinal slot, it is also immediately achieved that on the other or respectively remaining portion of the length, the movement block does not come into effect.

In a further detail, the pivot bolt has an actuation side, onto which action is carried out for example by the thumb of a user for adjustment in the first direction of movement, and a side lying opposite the actuation side, viewed in the first direction of movement. The opposite side is preferably formed by a cylinder portion circumferentially, in relation to a circumferential direction concerning the first direction of movement. Here, it is further preferred that the cylinder portion has a different extent over the circumference in the first direction of movement.

Opposite flat portions, viewed in the direction of the actuation side, adjoin the cylinder portion. A first flat portion can have the one or more mating teeth, wherein this first flat portion in the region of the mating teeth is no longer constructed flat in this sense. In the same manner, the opposite second flat portion can have a spring element arranged with an effective direction transversely to the first movement. This spring element is preferably intended to enable a ratchet-like passing over of the engagement teeth or respectively to make it possible that the pivot bolt comes free of the toothing with only tensile load of the movable pliers leg transversely to the longitudinal extent of the longitudinal slot. In the region of the spring element, the second flat portion is also not constructed flat in the actual sense.

A flat portion is achieved through a flattening of an otherwise cylindrical basic form. Preferably, the flat portion has, at least partially, a planar surface.

It is further preferred that the cylinder portion of the opposite side associated with the second flat portion is constructed with the greater length. Accordingly, the second flat portion is smaller in terms of length in its extent in the first direction of movement than the first flat portion, with which the smaller length of the cylinder portion is associated. The length is observed here as seen in the direction of an extent of the mating teeth.

Since, further preferably, the pivot bolt on the side which has the longer said cylinder extent, cooperating with the recess in the longitudinal slot, moves deeper into the longitudinal slot in a direction opposed to the direction of movement on pressing down, the movement block is thus achieved. The spring element projecting over the second flat side can no longer come into effect. The second flat side can no longer be moved up to the associated surface of the longitudinal slot with moving in of the spring element.

This longer region of the cylinder portion in the state of the movement block meets against a shoulder, formed as a result of the recess, in the longitudinal slot. Although the spring element also acts on this side, it can not come into effect as a result of the blocking of the movement of the pivot bolt in the second direction of movement necessary for this, through the said shoulder. A movement of the pivot bolt transversely to the longitudinal extent of the longitudinal slot is not possible in such a position of the pivot bolt with respect to the length of the longitudinal slot.

Figure 2:
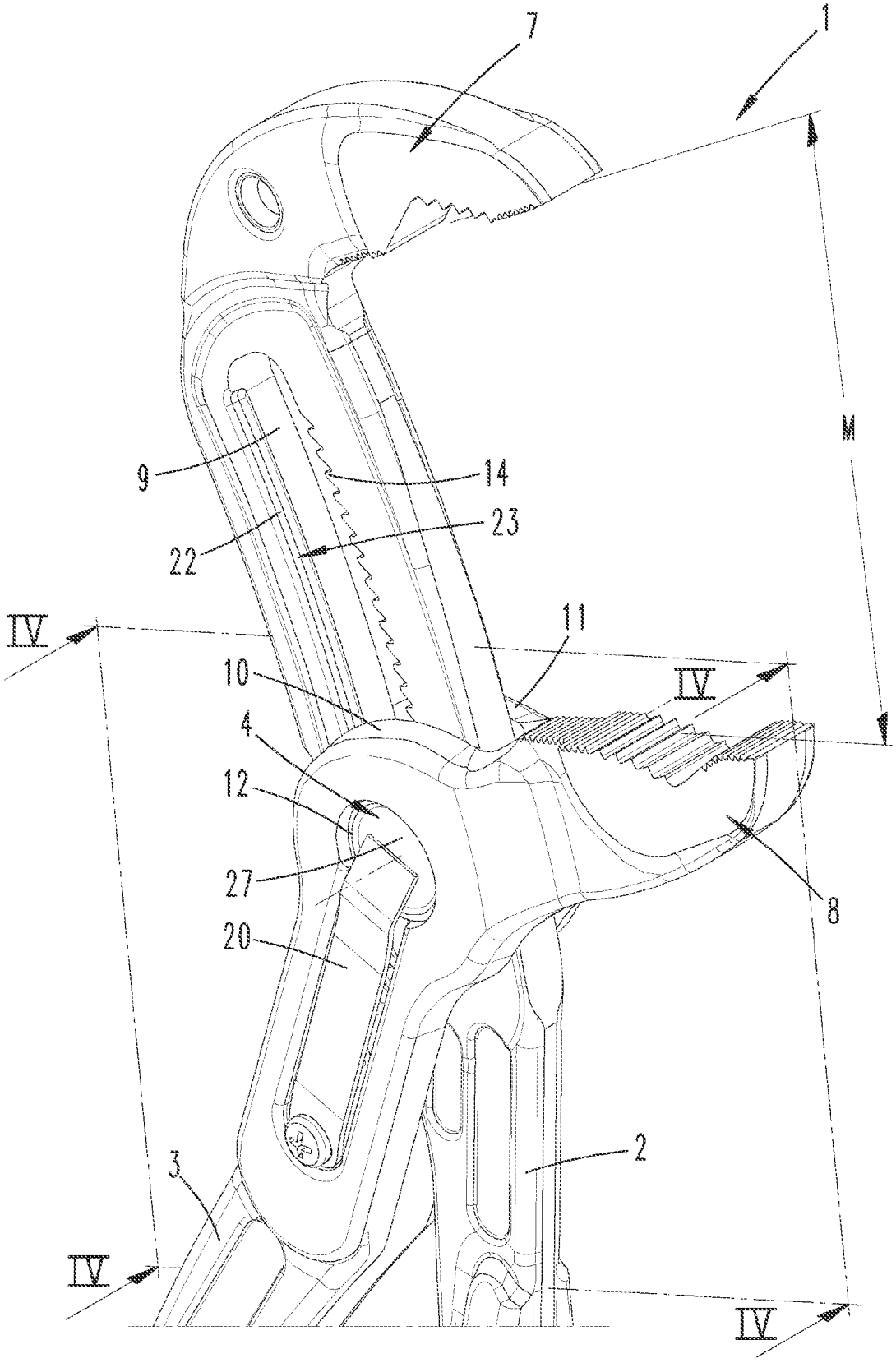
Figure 3:
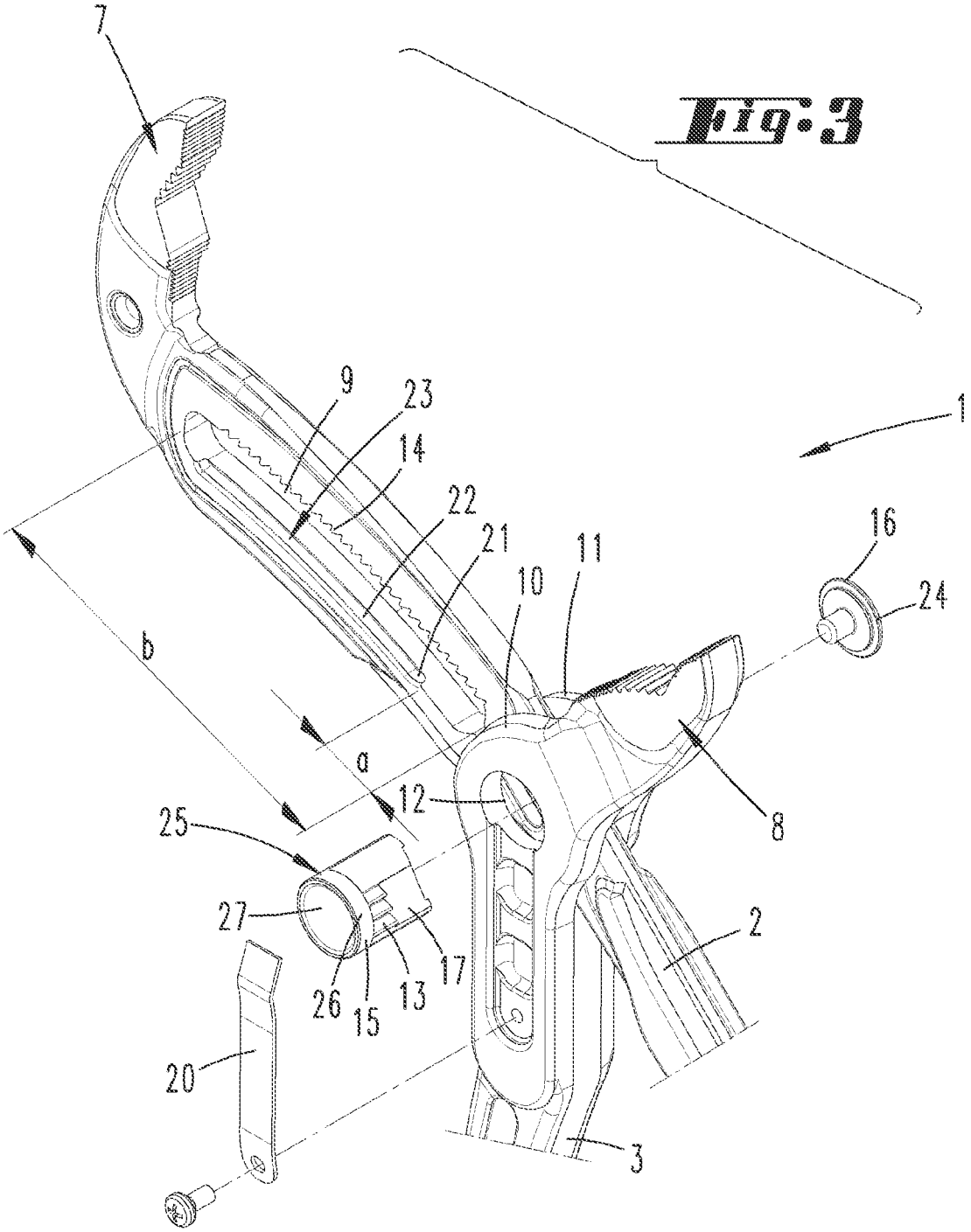
Figure 4:
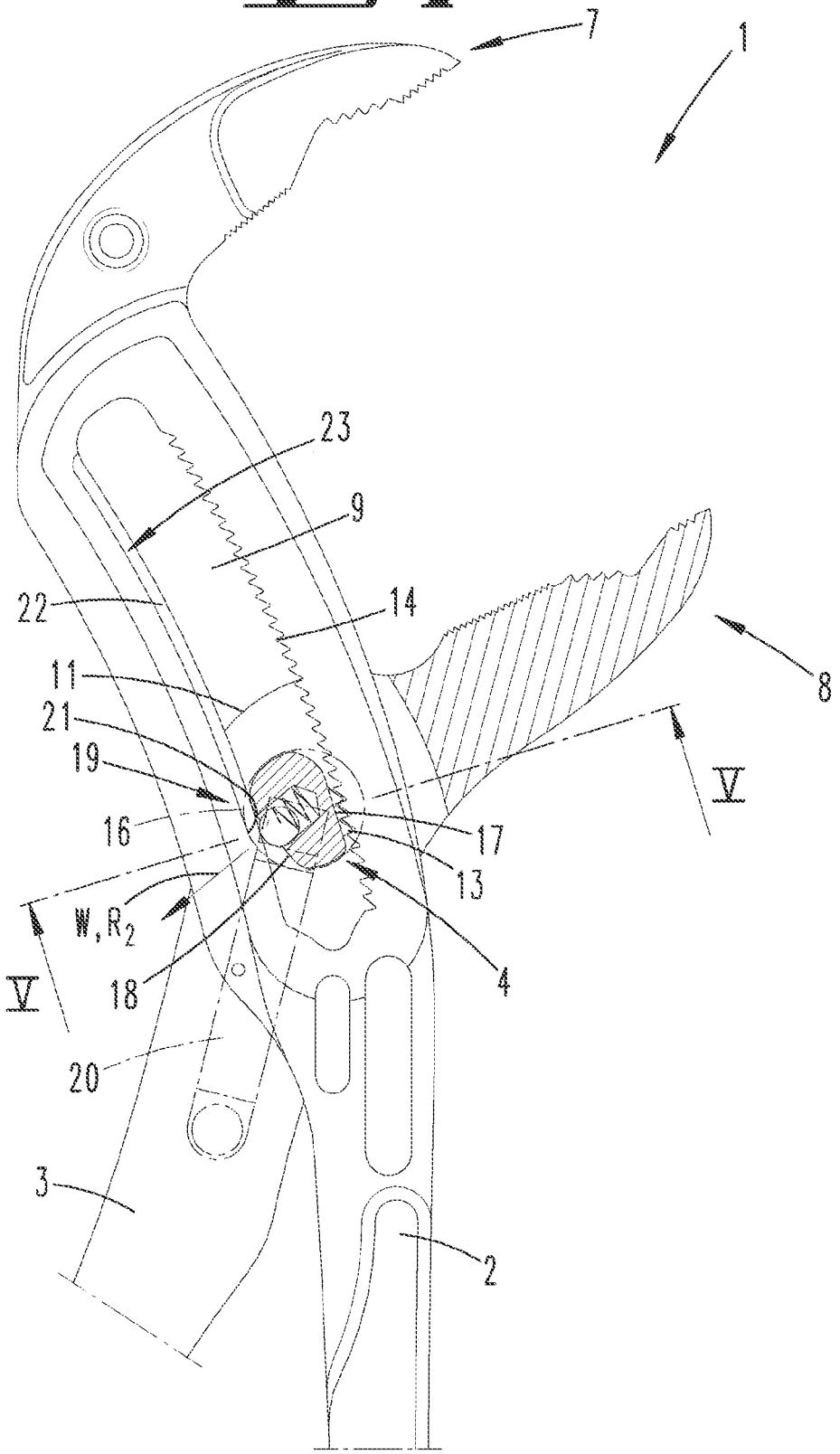
Figure 5:
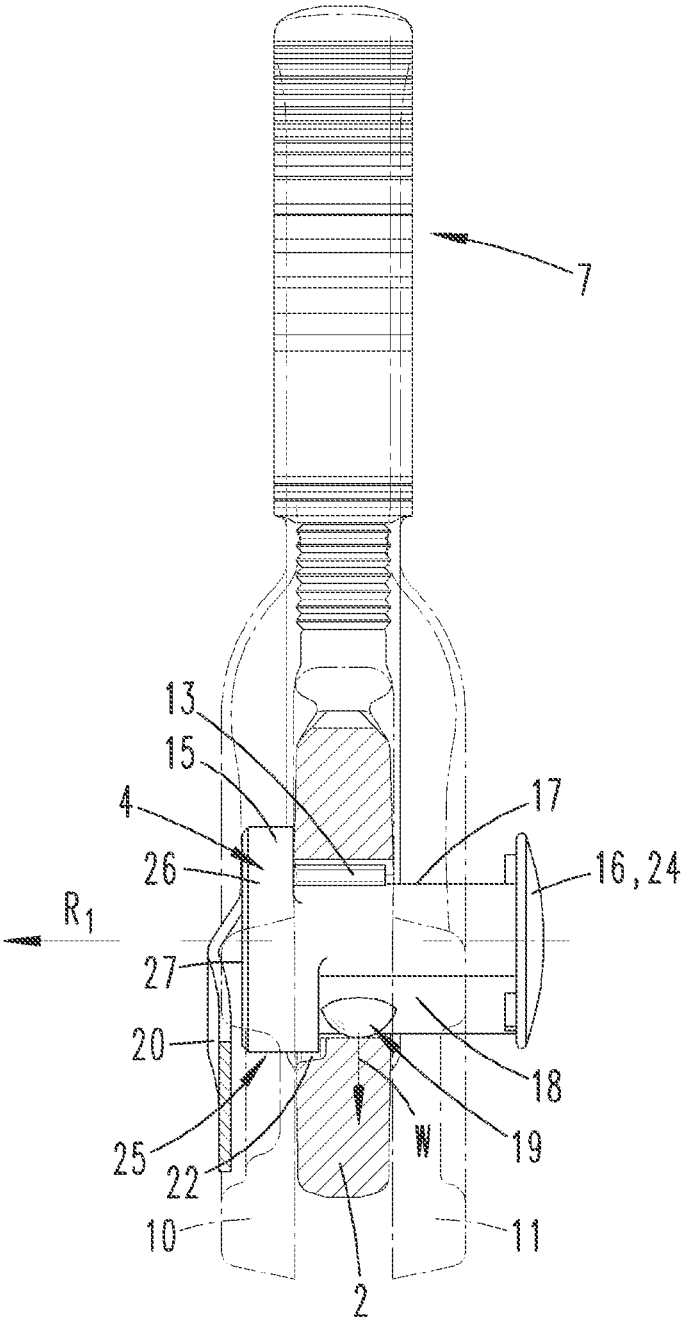
Figure 6:
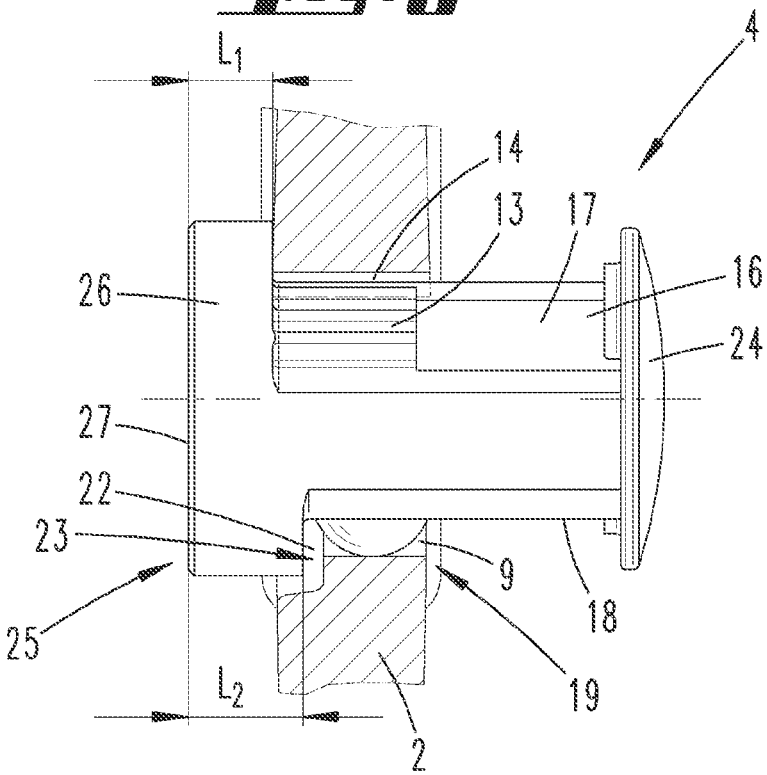
Figure 7:
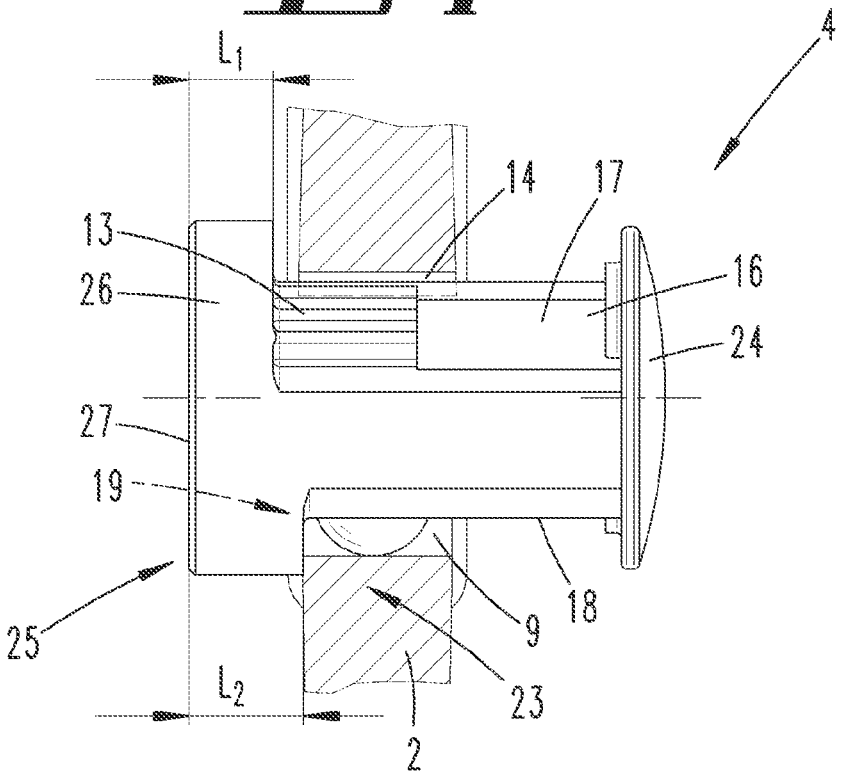
Figure 8:
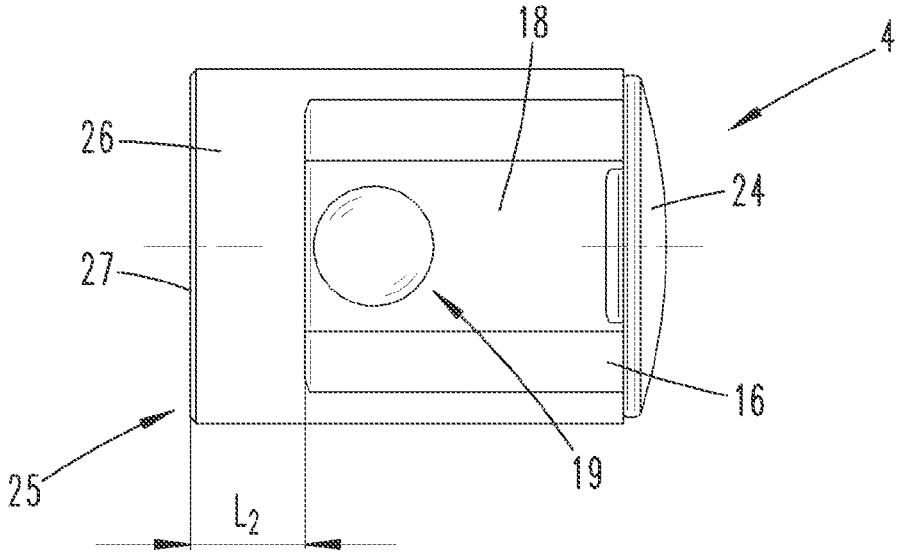
Figure 9:
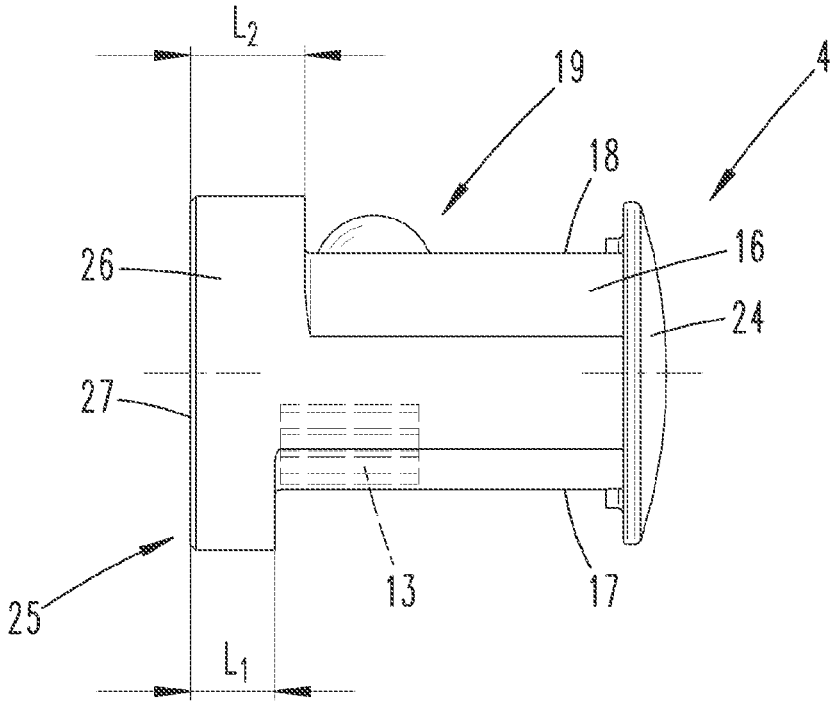
Figure 10:
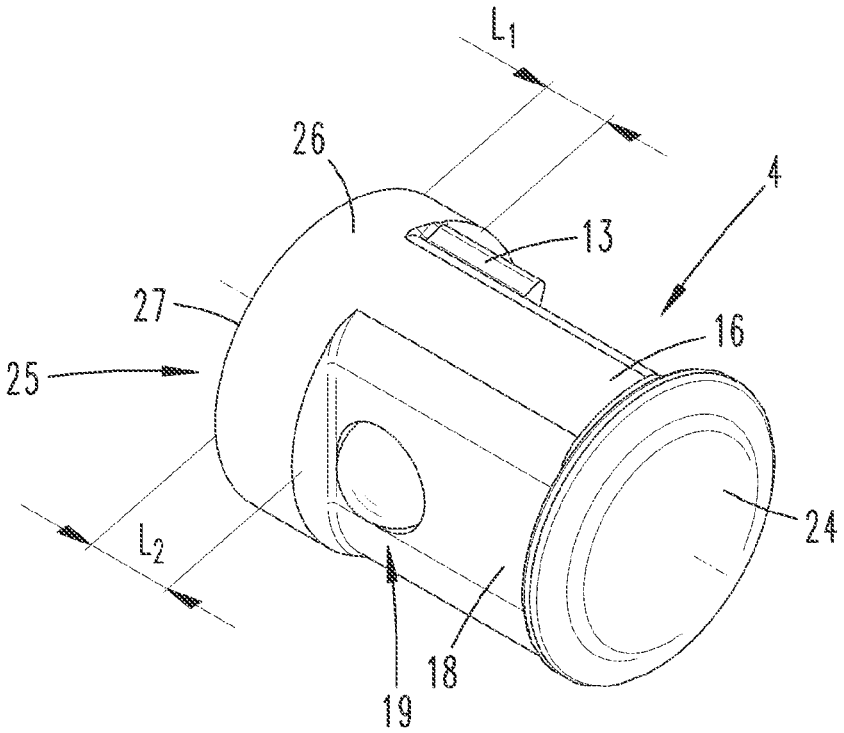
Figure 11:
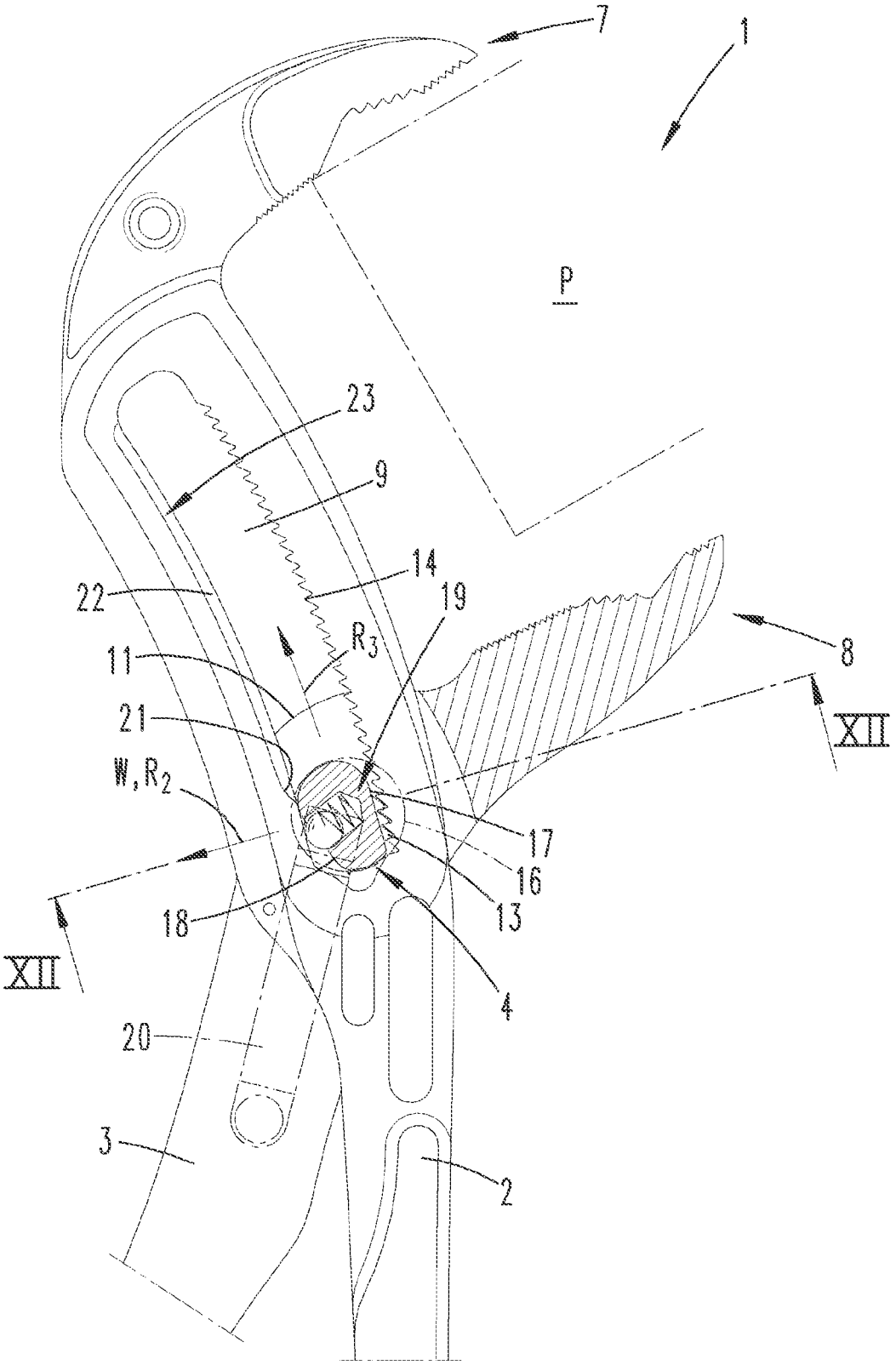
Figure 12:
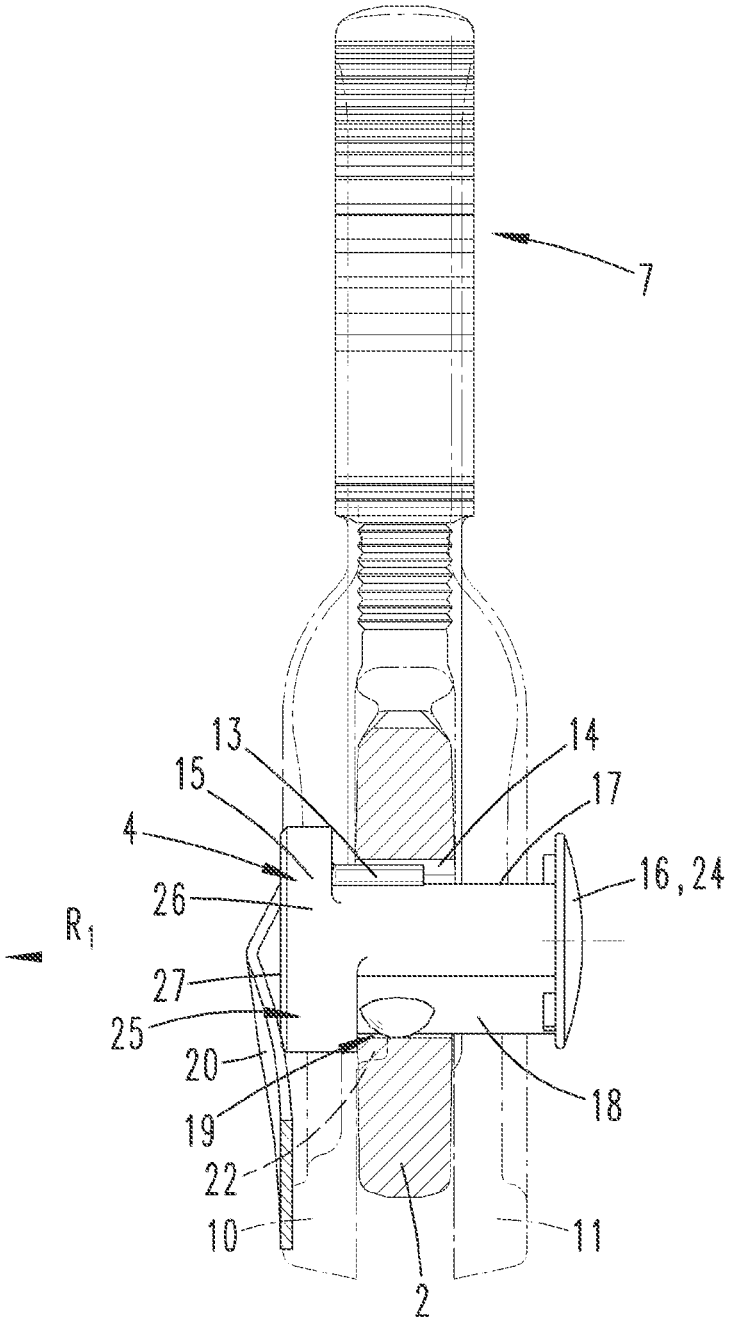

The invention is explained further below with the aid of the enclosed drawings which, however, illustrate only one example embodiment. There are shown here:

FIG. 1 a perspective illustration of the pliers in the non-actuated state;

FIG. 2 an enlarged illustration of the region of the longitudinal slot and of the pliers mouth, with a large mouth opening width;

FIG. 3 an exploded illustration of the pliers in the region of the longitudinal slot and of the pliers mouth, in relation to the pivot bolt;

FIG. 4 a cross-section through the pliers, in section in the plane IV-IV in FIG. 2;

FIG. 5 a further cross-section through the pliers according to FIG. 4, in section in the plane V-V;

FIG. 6 an enlargement of the pivot bolt in the position according to FIG. 4;

FIG. 7 an illustration according to FIG. 6, but with greatest mouth opening;

FIG. 8 a side view of the pivot bolt;

FIG. 9 a further side view of the pivot bolt, with pivot bolt rotated through 45° with respect to the position according to FIG. 8;

FIG. 10 a perspective view of the pivot bolt from obliquely front;

FIG. 11 a cross-sectional illustration of the pliers according to FIG. 4, but with greatest possible mouth opening width and with pivot bolt drawn from the engagement position; and FIG. 12 a cross-section through the pliers, in section along the line XII-XII in FIG. 11.

Firstly with reference to FIGS. 1 and 2, a pliers 1 is illustrated and described, in a preferred embodiment as a water pump pliers with two pliers legs 2, 3. The pliers legs 2, 3 cross in a region of a pivot bolt 4.

The pliers leg 2 is to be regarded as a fixed pliers leg. The pliers leg 3 is movable relative to the pliers leg 2 for changing the mouth opening width M, see FIG. 2. At the same time, the pliers leg 3 is pivotable relative to the pliers leg 2, with the pivot bolt 4 as joint axis, for opening and closing the pliers mouth.

The pliers legs, 2, 3 form, on one side of the pivot bolt 4, the grip portion 5, 6 and, on the other side of the pivot bolt 4, mouth jaws 7, 8.

The movable pliers leg 3 is preferably configured so as to be fork-shaped in the crossing region, for the embracing, on both sides, of the fixed shank portion having a longitudinal slot 9. The pivot bolt 4 is held rotatably in a portion, preferably the fork portion 10, 11, of the movable pliers leg 3. For this, in the portion, in particular in the fork portion 10 and in the fork portion 11 in each case a through-opening 12 is formed.

Mating teeth 13, formed in addition on the pivot bolt, can come into engagement with engagement teeth 14, which are formed on a flank—preferably only on one flank—of the longitudinal slot 9.

As a result of a cylinder portion 15 on the pivot bolt 4, into which the mating teeth 13 enter, a stop is created on the base side, therefore on the side of the cylinder portion 15 of the mating teeth 13 in the engagement state, which stop prevents the pivot bolt 4 from being able to be inserted from this side through the longitudinal slot 9.

On the other side, see for instance FIG. 5, the pivot bolt 4 is formed with a head part 16 which forms an edge-side or respectively radial overlap, which in the same manner comes into effect as a stop when the pivot bolt 4 of this side is pressed down in a first direction of movement $R_1$ for displacement in the longitudinal slot 9. Furthermore, the cylinder portion 15, see for instance FIG. 5, is, however, also formed with such a radial overlap that through striking against the pliers leg 2 it prevents a further entering of the pivot bolt 4 also in a state in which the engagement teeth and the mating teeth are out of engagement, see for example FIG. 11.

The mating teeth 13 are formed on a first flat side 17 of the pivot bolt 4. On an opposite second flat side 18 a spring element 19 comes into effect, with an effective direction W, which runs transversely to the first direction of movement $R_1$, see FIG. 5. The flat sides 17, 18 are not in alignment in a cross-section, see for instance FIG. 11, but rather are aligned running at an acute angle to one another. This enables the movement of the pivot bolt in the direction of the second direction of movement $R_2$, as further explained below. Here, this is, in the narrower sense, substantially a circular movement of the pivot bolt.

As a result of the spring element 19, the pivot bolt in a position of the pliers legs according to FIG. 11 can be brought out of effect by merely drawing on the first pliers leg 3. The pivot bolt 4 moves here in the direction of a second direction of movement $R_2$. The second direction of movement $R_2$ can coincide substantially with the effective direction W. The mating teeth 13 come hereby out of engagement to the mating teeth 14 of the longitudinal slot 9. Basically, the second, or respectively movable pliers leg 3 in such a position of the pivot bolt 4 can be moved with regard to the longitudinal slot 9 freely in relation to the first or respectively fixed pliers leg 2.

The pliers 1 has a movement block with regard to the pivot bolt 4. The movement block brings it about that the pivot bolt 4 or respectively the movable pliers leg 3 as a whole is to be moved to a displacement of the mouth opening width M, i.e. for the movement of the pivot bolt 4 in a longitudinal direction of the longitudinal slot 9, which movement is also designated as third direction of movement $R_3$, only by pressing down in the direction of the first direction of movement $R_1$.

The movement block is primarily achieved by a particular configuration of one of the pliers legs, here of the fixed pliers leg 2. It is also provided only for a portion of the engagement teeth with the longitudinal slot 9.

The movement block can be brought into effect as a result of a displacement of the pliers leg 3 from a particular mouth opening with M, here preferably the greatest mouth opening according to FIG. 11, in the direction of a smaller mouth opening width. The displacement takes place in the third direction of movement $R_3$ of the pivot bolt of the pivot bolt 4.

In a further detail, the movement block is achieved in that the pivot bolt 4 moves in the direction opposed to the first direction of movement $R_1$, in which it is preferably prestressed by an impinging bolt spring 20, so deeply from the side concerned into the longitudinal slot 9, see FIG. 5, that on the side of the spring element 19 the cylinder portion 15, at least over a portion of its height, is in immediate opposite position to a stop surface 21 extending in longitudinal direction of the longitudinal slot 9. Thereby, it is no longer possible, as previously described, with diversion of the spring element 19, to draw the pivot bolt 4 out from the toothing engagement to the teeth of the longitudinal slot 9. The second direction of movement $R_2$ is blocked.

This dipping into the longitudinal slot 9 is achieved by a recess 22, also forming the stop surface 21, in a longitudinal flank 23 of the elongated slot 9 (cf. in particular FIGS. 4, 5).

This recess 22, as can be seen in particular also from FIG. 3, is formed only over a portion of the length b of the longitudinal slot 9. A further, immediately adjoining portion a of the longitudinal slot 9 is formed without this recess 22. Accordingly, the length of the recess 22 corresponds substantially (with the exception for instance of the rounding region on the mouth jaw side) to the difference b−a. The portion a can correspond here to half up to for example 9/10 of the total length b of the longitudinal slot 9.

Further preferably, the configuration of the longitudinal slot 9 over the length a is formed only in opposite position to a small portion of the teeth of the longitudinal slot 9. Further preferably, in opposite position to one tenth up to one third of the teeth of the longitudinal slot 9. Viewed in absolute terms, in the region of the portion a two to ten, preferably approximately five engagement teeth 14 can be formed. The length a also preferably corresponds to a diameter of the cylindrical portion of the pivot bolt 4, which is situated in the non-actuated state in the longitudinal slot (and is flattened partially as a result of the flat sides 17, 18).

The position of the pivot bolt 4 with deeper dipping into the longitudinal slot 9 as a result of the recess 22 is highlighted again in FIG. 6. In FIG. 7 an identical illustration is given, but in a region of the longitudinal slot 9 in which the pivot bolt 4 does not move deeply into the longitudinal slot 9.

The pivot bolt 4 as such is illustrated in further detail in FIGS. 8 to 10.

On the actuation side, the pivot bolt 4 has a head part 24. This projects at least partially radially and can thus, in cooperation for instance with the teeth of the longitudinal slot 9, form a stop for a pressing in of the pivot bolt in the first direction of movement.

The pivot bolt 4, configured completely cylindrically substantially at the starting point with the exception of the head part, is formed beneath the head part 24 with the already mentioned opposite flat sides, first flat side 17 and second flat side 18.

A foot region 25 of the pivot bolt 4, lying opposite the head part 24, is firstly formed with a circumferential first cylinder portion 26. Associated with the second flat side 18, this cylinder portion 26, viewed contrary to the first direction of movement $R_1$, is formed with a greater length $L_2$ than corresponding to the first length $L_1$ of the circumferential cylinder portion.

The length $L_2$ can be for example 1.1 to 1.8 times the length $L_1$.

On the support surface 27 of the pivot bolt 4 lying opposite the surface of the head part 24, in the example embodiment the bolt spring 20 (cf. FIG. 2) is in action, which prestresses the pivot bolt 4 into its position or rest or respectively engagement provided outside an actuation.

The means for the formation of the movement block are therefore primarily provided by the recess 22 and the stop surface 21 in the fixed pliers leg, but partially also by the formation of the cylinder portion 15 of different height in the pivot bolt 4. Through a corresponding formation of a recess also on the opposite longitudinal flank of the longitudinal slot 9, different lengths of the cylinder portion 15 of the pivot bolt 4 could also be dispensed with.

A use of the pliers can now take place as follows:

Proceeding from a greatest mouth width according to FIG. 11, a user can either by displacing the pliers legs 2, 3 relative to one another, so that the pivot bolt 4 travels in the direction of the third direction of movement $R_3$, achieve a ratchet-like passing over of the teeth of the longitudinal slot by the mating teeth, until a desired mouth opening width M is provided. Here, the pivot bolt 4 moves on passing over of an engagement tooth in the second direction of movement $R_2$. Or the user can, for example also in the position of the greatest mouth opening width M according to FIG. 11, bring the mating teeth 13 out of engagement to the engagement teeth 14 by pressing down in the first direction of movement $R_1$ of the pivot bolt 4, and in this pressed-down position of the pivot bolt 4 then displace the pliers legs in the direction of the third direction of movement $R_3$ with respect to one another for setting a desired mouth width.

The ratchet-like advancing of the mouth opening is able to be carried out particularly favourably when the pliers are already associated with a workpiece P, cf. FIGS. 11 and 12 and the mouth jaws are then brought to abutment through this said displacement. Irrespective of the fact that in the case of such a ratchet-like displacement of the pliers jaws together for setting a mouth width, the pivot bolt 4 is already moved into the region of the longitudinal slot, in which the movement block can come into effect, the configuration permits this advancing through ratchet-like passing over to still be able to be carried out up to closure. For this, it can, however, be necessary that the displacement of the pliers legs or respectively pliers jaws together is carried out sufficiently expeditiously by a user. After a completing of this displacement, when therefore the pliers jaws have come respectively to abut on the workpiece P for example, the bolt spring 20 brings it about that the pivot bolt, which is then usually situated in the region of the recess 22, is pressed into the longitudinal slot contrary to the first direction of movement $R_1$, and hereby moves immediately into the position according to FIG. 6 for example. Thereby, a movement block is achieved. The pivot bolt 4 can no longer be moved out from the toothing by mere moving in the second direction of movement $R_2$, transversely to the first direction of movement $R_1$.

Rather, a further adjustment of the mouth opening of the pliers, also in the direction of a greater mouth opening, is only possible by pressing down of the pivot bolt 4 in the direction of the first direction of movement $R_1$, and then in the pressed-down state of the pivot bolt 4, moving of the pliers in or contrary to the first direction of movement $R_3$ into the desired new mouth opening width M.

In so far as the desired mouth opening width is then provided in the longitudinal region a of the longitudinal slot 9, a ratchet-like passing over, in the direction of a smaller mouth opening, can also be readily carried out again from this position.

All disclosed features are (by themselves) essential to the invention. Herewith also, the disclosure content of the associated/enclosed priority documents (copy of the earlier application) are also included in full into the disclosure of the application, also for the purpose of including features of these documents into claims of the present application. The subclaims characterize in their optionally independent formulation independent inventive further developments of the prior art, in particular in order to carry out divisional applications on the basis of these claims.

LIST OF REFERENCE NUMBERS

1 pliers
2 pliers leg
3 pliers leg
4 pivot bolt
5 grip portion
6 grip portion
7 mouth jaw
8 mouth jaw
9 longitudinal slot
10 fork portion
11 fork portion
12 through-opening
13 mating teeth
14 engagement teeth
15 cylinder portion
16 head part
17 first flat side
18 second flat side
19 spring element
20 bolt spring
21 stop surface
22 recess
23 longitudinal flank
24 head part
25 foot region
26 cylinder portion
27 bearing surface
M mouth opening width
$R_1$ first direction of movement
$R_2$ second direction of movement
$R_3$ third direction of movement
W effective direction
P workpiece
a length (of the longitudinal slot)
b part (of the longitudinal slot)
$L_1$ length
$L_2$ length

The invention claimed is:

1. A pliers comprising:

two pliers legs, one of the pliers legs forming a fixed pliers leg and the other of the pliers legs being movable relative to the fixed pliers leg, the fixed pliers leg having a longitudinal slot therein with engagement teeth formed over an extent thereof, a pivot bolt connecting the pliers legs so that the legs cross at the pivot bolt and form grip portions on one side of the pivot bolt and mouth jaws on the other side of the pivot bolt, the pivot bolt having mating teeth that are engageable with the engagement teeth in the longitudinal slot of the fixed pliers leg in order to set a mouth opening width (M) and a spring element having an effective direction, for moving the mating teeth into engagement with the engagement teeth, and a bolt spring connected to the movable pliers leg and to the pivot bolt and being configured for holding the pivot bolt in place, wherein the pivot bolt is releasable from engagement with the engagement teeth by pressing down the pivot bolt against the bolt spring in a first linear direction of movement (R1), the effective direction being transverse to the first linear direction (R1), and subsequently displacing the pliers legs along the longitudinal slot together with the pivot bolt pressed down, wherein the fixed pliers leg is provided with a movement block in the form of a recess in a flank of the longitudinal slot, wherein an overall length of the recess is less than an overall length of the longitudinal slot, such that the pivot bolt is able to move more deeply into the longitudinal slot in the area of the recess than in an area of the longitudinal slot with no recess by being pressed by the bolt spring in a direction opposite to the first direction of movement (R1), wherein when the pivot bolt is located in the area with no recess, the pivot bolt is adapted to move in a direction (R2) that is transverse to the first direction of motion (R1) and slide in a ratcheting motion along the engagement teeth in a third direction of movement (R3) that is transverse to the first direction of movement (R1), to a desired position in the longitudinal slot by moving the pliers legs relative to each other without having pressed down the pivot bolt, and once the desired position is reached, the pivot bolt extends more deeply into the longitudinal slot, further adjustment is possible only by pressing down the pivot bolt in the first movement direction (R1).

2. The pliers according to claim 1, wherein the pivot bolt (4) has an actuation side and an opposite side, viewed in the first direction of movement ($R_1$), wherein the opposite side is formed by a cylinder portion (26), which has over the circumference a different extent in the first direction of movement ($R_1$) and the different extent of the cylinder portion engages a the fixed pliers leg 2.

3. The pliers according to claim 2, wherein opposite flat sides (17, 18) adjoin the cylinder portion (26) in the direction of the actuation side, wherein in one of the flat sides (17, 18) the one or more mating teeth (13) are formed and in the other flat portion a spring element (19) is provided, arranged with an effective direction transversely to the first direction of movement (R).

4. The pliers according to claim 3, wherein the cylinder portion (15) is formed associated with the other flat side (18) has the greater length.

* * * * *